US009168631B2

(12) United States Patent
Rahmathullah et al.

(10) Patent No.: US 9,168,631 B2
(45) Date of Patent: Oct. 27, 2015

(54) TWO-PART RETAINING RING WITH INTERLOCK FEATURES

(71) Applicant: Applied Materials, Inc., Santa Clara, CA (US)

(72) Inventors: Irfanulla Khuddus Rahmathullah, Bangalore (IN); Bopanna Ichettira Vansantha, Bangalore (IN); Padma Gopalakrishnan, Fremont, CA (US); Aswathnarayanaiah Ravi, Bangalore (IN); Abraham Palaty, Thrissur (IN); Young J. Paik, Campbell, CA (US); Stacy Meyer, San Jose, CA (US); James Klingler, San Jose, CA (US); Ashish Bhatnagar, Fremont, CA (US)

(73) Assignee: Applied Materials, Inc., Santa Clara, CA (US)

( * ) Notice: Subject to any disclaimer, the term of this patent is extended or adjusted under 35 U.S.C. 154(b) by 54 days.

(21) Appl. No.: 13/907,658

(22) Filed: May 31, 2013

(65) Prior Publication Data

US 2013/0324017 A1 Dec. 5, 2013

Related U.S. Application Data

(60) Provisional application No. 61/655,925, filed on Jun. 5, 2012.

(51) Int. Cl.
*B24B 37/32* (2012.01)

(52) U.S. Cl.
CPC ..... *B24B 37/32* (2013.01)

(58) Field of Classification Search
CPC ..... B24B 37/30; B24B 37/32
USPC ..... 451/283–291, 397, 398, 402
See application file for complete search history.

(56) References Cited

U.S. PATENT DOCUMENTS 5,738,574 A 4/1998 Tolles et al.
6,110,026 A * 8/2000 Arai ..... 451/289
6,183,354 B1 2/2001 Zuniga et al.

(Continued)

FOREIGN PATENT DOCUMENTS

KR 10-2008-0109119 12/2008

OTHER PUBLICATIONS

International Search Report and Written Opinion in International Application No. PCT/US2013/042087, mailed Aug. 26, 2013, 9 pages.

*Primary Examiner* — Maurina Rachuba
*Assistant Examiner* — Marcel Dion
(74) *Attorney, Agent, or Firm* — Fish & Richardson P.C.

(57) ABSTRACT

A retaining ring includes an annular lower portion and an annular upper portion. The annular lower portion has a main body with a bottom surface for contacting a polishing pad during polishing, an inner rim projecting upward from the main body, an outer rim projecting upward from the main body and separated from the inner rim by a gap, and a plurality of azimuthally separated interlock features positioned between the inner rim and the outer rim, each interlock feature projecting upwardly from the main body. The annular upper portion has a top surface and a bottom surface and a plurality of azimuthally separated recesses in the bottom surface, the recesses defining thin portions of the upper portion, the plurality of interlock features fitting into the plurality of recesses. The lower portion is a plastic and the upper portion is a material that is more rigid than the plastic.

18 Claims, 3 Drawing Sheets

(56) References Cited

U.S. PATENT DOCUMENTS

| | | | | |
|---|---|---|---|---|
| 6,368,191 | B1 * | 4/2002 | Zuniga et al. | 451/41 |
| 6,390,904 | B1 * | 5/2002 | Gleason et al. | 451/286 |
| 6,913,669 | B2 * | 7/2005 | Ensinger | 156/345.14 |
| 7,134,948 | B2 * | 11/2006 | Tseng et al. | 451/288 |
| 7,497,767 | B2 * | 3/2009 | Chen et al. | 451/398 |
| 7,575,504 | B2 | 8/2009 | Zuniga et al. | |
| 2003/0070757 | A1 | 4/2003 | DeMeyer et al. | |
| 2004/0067723 | A1 | 4/2004 | Ensinger | |
| 2004/0077167 | A1 * | 4/2004 | Willis et al. | 438/689 |
| 2004/0219870 | A1 * | 11/2004 | Chen et al. | 451/422 |
| 2005/0095964 | A1 * | 5/2005 | Hengel | 451/285 |
| 2007/0262488 | A1 * | 11/2007 | Chen | 264/249 |
| 2008/0102732 | A1 * | 5/2008 | Severson et al. | 451/5 |
| 2010/0144255 | A1 * | 6/2010 | Bennett et al. | 451/398 |
| 2011/0151755 | A1 | 6/2011 | Burns et al. | |

* cited by examiner

TWO-PART RETAINING RING WITH INTERLOCK FEATURES

CROSS-REFERENCE TO RELATED APPLICATION

This application claims priority to U.S. Provisional Application No. 61/655,925, filed Jun. 5, 2012, the entire disclosure of which is incorporated by reference.

TECHNICAL FIELD

The present disclosure relates to a retaining ring for a carrier head for chemical mechanical polishing.

BACKGROUND

Integrated circuits are typically formed on substrates, particularly silicon wafers, by the sequential deposition of conductive, semiconductive or insulative layers. One fabrication step involves depositing a filler layer over a non-planar surface and planarizing the filler layer. For certain applications, the filler layer is planarized until the top surface of a patterned layer is exposed. A conductive filler layer, for example, can be deposited on a patterned insulative layer to fill the trenches or holes in the insulative layer. After planarization, the portions of the conductive layer remaining between the raised pattern of the insulative layer form vias, plugs, and lines that provide conductive paths between thin film circuits on the substrate. For other applications, such as oxide polishing, the filler layer is planarized until a predetermined thickness is left over the non-planar surface. In addition, planarization of the substrate surface is usually required for photolithography.

Chemical mechanical polishing (CMP) is one accepted method of planarization. This planarization method typically requires that the substrate be mounted on a carrier head. The exposed surface of the substrate is typically placed against a rotating polishing pad. The carrier head provides a controllable load on the substrate to push it against the polishing pad. A polishing liquid, such as slurry with abrasive particles, is typically supplied to the surface of the polishing pad.

The substrate is typically retained below the carrier head by a retaining ring. However, because the retaining ring contacts the polishing pad, the retaining ring tends to wear away, and is periodically replaced. Some retaining rings have an upper portion formed of metal and a lower portion formed of a wearable plastic, whereas some other retaining rings are a single plastic part.

SUMMARY

Retaining rings can be expensive, and as noted above, need to be periodically replaced when worn. In some conventional retaining rings the plastic lower portion is secured to the metal upper portion by an adhesive.

A technique is to use mechanical fasteners to secure the lower portion to the upper portion, but have the lower portion be thicker where the fasteners are inserted. This makes refurbishing of the retaining ring easier, and the thicker portions can provide interlocking features that prevent slippage of the lower ring relative to the upper ring.

In one aspect, a retaining ring includes an annular lower portion and an annular upper portion. The annular lower portion has a main body with a bottom surface for contacting a polishing pad during polishing, an inner rim projecting upward from the main body, an outer rim projecting upward from the main body and separated from the inner rim by a gap, and a plurality of azimuthally separated interlock features positioned between the inner rim and the outer rim, each interlock feature projecting upwardly from the main body. The annular upper portion has a top surface and a bottom surface and a plurality of azimuthally separated recesses in the bottom surface, the recesses defining thin portions of the upper portion, the plurality of interlock features fitting into the plurality of recesses. The lower portion is a plastic and the upper portion is a material that is more rigid than the plastic.

Implementations may include one or more of the following features. The material may be a metal or ceramic. The lower portion may have a durometer measurement between about 80 and 95 on the Shore D scale. The lower portion may have a plurality of threaded recesses formed in top surfaces of at least some of the interlock features, and the upper portion may include a plurality of apertures formed through the thin portions and aligned with the threaded apertures. A plurality of mechanical fasteners may extend through the plurality of apertures into the plurality of threaded recesses. The top surfaces of the plurality of mechanical fasteners may be recessed relative to the top surface of the upper portion. The top surface of the upper portion may be flush with a top surface of the inner rim. A top surface of the inner rim is flush with a top surface of the outer rim. There may be an annular recess in a top surface of the inner rim and an O-ring fit into the annular recess. The bottom surface of the lower portion may have channels for slurry transport. The lower portions may be secured to the upper portion without adhesive. The top surface of the upper portion may include a hole to receive a fastener to mechanically affix the retaining ring to the base. Azimuthal side surfaces of the plurality of interlock features may directly contact azimuthal side surfaces of the plurality of recesses.

Advantages of implementations may include one or more of the following. Refurbishing a retaining ring in which the upper and lower portions are secured by mechanical fasteners may be easier than refurbishing a retaining ring in which the upper and lower portions are secured by an adhesive. Interlocking features may prevent slippage of the lower ring relative to the upper ring.

The details of one or more implementations are set forth in the accompanying drawings and the description below. Other features, objects, and advantages will be apparent from the description and drawings, and from the claims.

DESCRIPTION OF DRAWINGS

Like reference symbols in the various drawings indicate like elements.

DETAILED DESCRIPTION

During a polishing operation, one or more substrates can be polished by a chemical mechanical polishing (CMP) apparatus that includes a carrier head 100. A description of a CMP apparatus can be found in U.S. Pat. No. 5,738,574.

Figure 1:
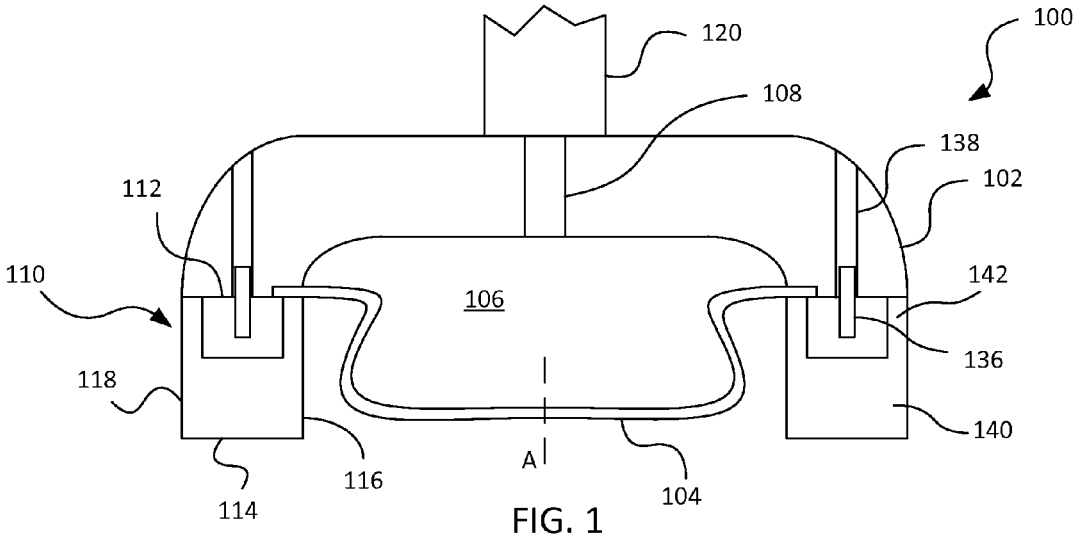
FIG. 1 is a schematic cross-sectional view of a carrier head.

Referring to FIG. 1, an exemplary simplified carrier head 100 includes a housing 102, a flexible membrane 104 that provides a mounting surface for the substrate, a pressurizable chamber 106 between the membrane 104 and the housing 102, and a retaining ring 110 secured near the edge of the housing 102 to hold the substrate below membrane 104. Although FIG. 1 illustrates the membrane 104 as clamped between the retaining ring 110 and the base 102, one or more other parts, e.g., clamp rings, could be used to hold the membrane 104. A drive shaft 120 can be provided to rotate and/or translate the carrier head across a polishing pad. A pump may be fluidly connected to the chamber 106 though a passage 108 in the housing to control the pressure in the chamber 106 and thus the downward pressure of the flexible membrane 104 on the substrate.

The retaining ring 110 may be a generally annular ring secured at the outer edge of the base 102, e.g., by screws or bolts 136 that extend through passages 138 in the base 102 into aligned threaded receiving recesses 139 (see FIG. 2) in the upper surface 112 of the retaining ring 110. In some implementations, the drive shaft 120 can be raised and lowered to control the pressure of a bottom surface 114 of the retaining ring 110 on a polishing pad. Alternatively, the retaining ring 110 can be movable relative to the base 120 and the carrier head 100 can include an internal chamber which can be pressurized to control a downward pressure on the retaining ring, e.g., as described in U.S. Pat. Nos. 6,183,354 or 7,575,504, which are incorporated by reference. The retaining ring 110 is removable from the base 102 (and the rest of the carrier head) as a unit. This means that an upper portion 142 of the retaining ring 110 remains secured to a lower portion 140 of the retaining ring while the retaining ring 110 is removed, without requiring disassembly of the base 102 or removal of the base 102 from the carrier head 100.

An inner surface 116 of retaining ring 110 defines, in conjunction with the lower surface of the flexible membrane 104, a substrate receiving recess. The retaining ring 110 prevents the substrate from escaping the substrate receiving recess.

Figure 2:
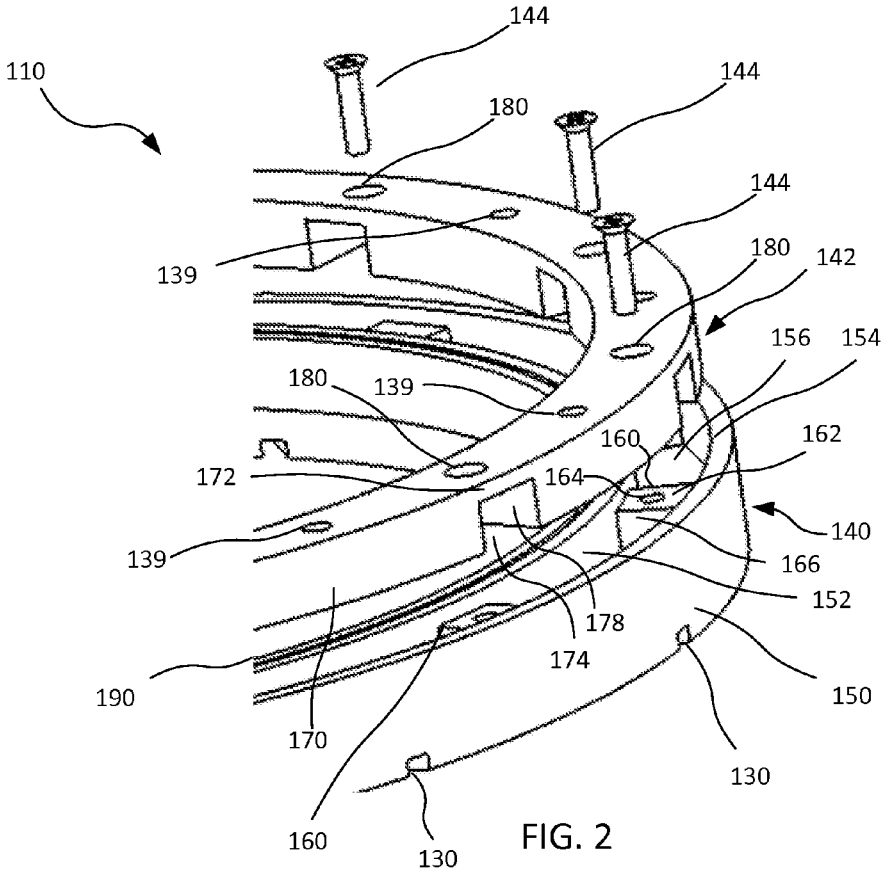
FIG. 2 is an exploded perspective view of a section of a retaining ring.
Figure 3:
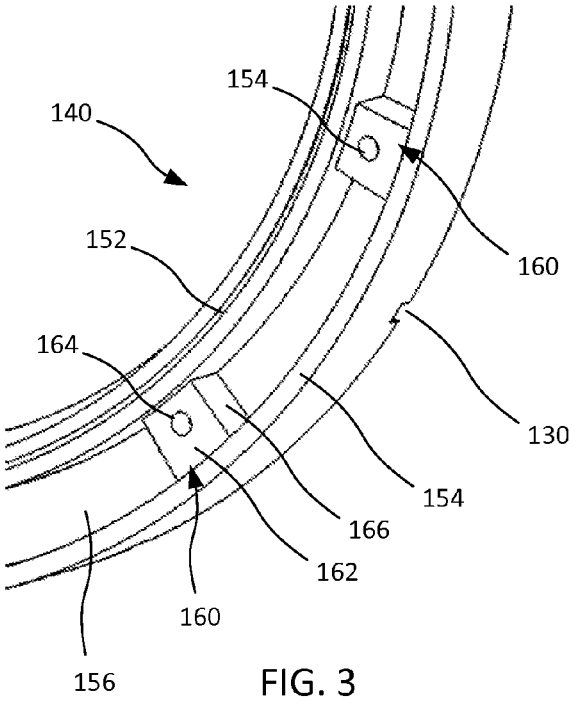
FIG. 3 is a perspective view of a section of the lower portion of the retaining ring of FIG. 1.
Figure 4:
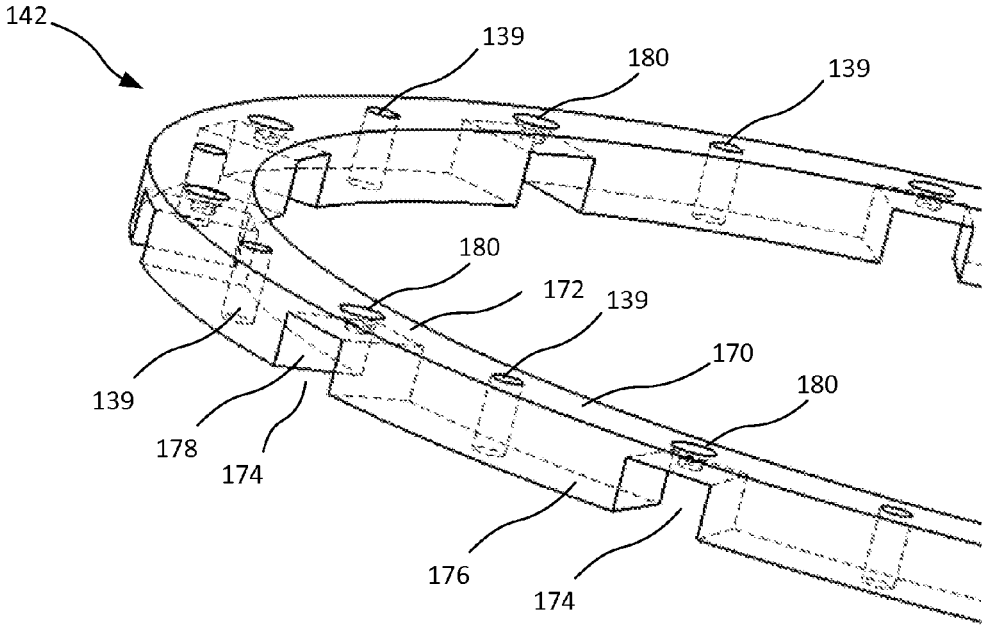
FIG. 4 is a perspective view of a section of the upper portion of the retaining ring of FIG. 2.

The bottom surface 114 of the retaining ring 110 can be substantially flat, or as shown in FIG. 2, in some implementations it may have a plurality of channels 130 that extend from the inner surface 116 to the outer surface 118 of the retaining ring to facilitate the transport of slurry from outside the retaining ring to the substrate. The channels 130 can be evenly spaced around the retaining ring. In some implementations, each channel 130 can be offset at an angle, e.g., 45°, relative to the radius passing through the channel.

Referring to FIGS. 2-5, the retaining ring 110 includes two vertically stacked sections, including the annular lower portion 140 having the bottom surface 114 that may contact the polishing pad, and the annular upper portion 142 connected to base 102. The lower portion 140 can be secured to the upper portion 142 with mechanical fasteners 144, e.g., screws or bolts.

The upper portion 142 of retaining ring 110 is composed of a more rigid material than the lower portion 140. The lower portion 140 can be a plastic, e.g., polyphenylene sulfide (PPS), whereas the upper portion can be a metal, e.g., stainless steel.

The plastic of the lower portion 140 is chemically inert in a CMP process. In addition, lower portion 140 should be sufficiently elastic that contact of the substrate edge against the retaining ring does not cause the substrate to chip or crack. On the other hand, lower portion 140 should be sufficient rigid to have sufficient lifetime under wear from the polishing pad (on the bottom surface) and substrate (on the inner surface). The plastic of the lower portion 140 can have a durometer measurement of about 80-95 on the Shore D scale. In general, the elastic modulus of the material of lower portion 140 can be in the range of about $0.3\text{-}1.0\times10^6$ psi. Although the lower portion can have a low wear rate, it is acceptable for the lower portion 140 to be gradually worn away, as this appears to prevent the substrate edge from cutting a deep grove into the inner surface 116.

The plastic of the lower portion 140 may be (e.g., consist of) polyphenylene sulfide (PPS), polyetheretherketone (PEEK), polyetherketoneketone (PEKK), polyetherketone (PEK), or a similar material. An advantage of polyphenylene sulfide (PPS) is that it is reliable and commonly used material for retaining rings.

The lower portion 140 includes a annular main body 150, an annular inner rim 152 that projects upwardly from the main body 150 at the inner edge of the main body, and an annular outer rim 154 that projects upwardly from the main body 150 at the outer edge of the main body 150. Between the inner rim 152 and the outer rim 154 is a gap 156. In some implementations, the inner rim 152 and the outer rim 154 have the same height, although this is not required. As shown in FIG. 2, the upper portion 142 of the retaining ring 110 fits into the gap 156 between the inner rim 152 and the outer rim 154. Thus, the inner rim 152 and outer rim 154 prevent radial slippage of the upper portion 142 relative to the lower portion 140.

Between the inner rim 152 and the outer rim 154 are a plurality of interlock features 160. The interlock features 160 are azimuthally spaced apart sections of the lower retaining ring where the main body 150 is thicker or where there is a projection upwardly from the main body 150. As shown in FIG. 2, the interlock features 160 fit into corresponding recesses 174 in the upper portion 142. Thus, the interlock features 160 prevent azimuthal slippage of the upper portion 142 relative to the lower portion 140.

In the implementation illustrated in FIGS. 2-5, the interlock features 160 extend from the inner rim 152 and outer rim 154, but this is not required; there could be a gap between the inner rim 154 and/or the outer rim 154 and the interlock feature 160. The top surface 162 of each the interlock feature 160 can be recessed relative to the top surface of the inner rim 152 and/or the outer rim 154.

A threaded recess 164 can be located in the top surface 162 of at least some of the interlock features 160. The threaded recess 164 extends vertically partially, not entirely, through the lower portion 140. The mechanical fastener 144 fits through an aperture 180 in the upper portion and into the threaded recess 164 (see FIGS. 2 and 5). This permits the lower portion 140 to be secured to the upper portion 142 without exposed screw holes on the bottom surface 114 of the retaining ring 110. The threads of the threaded recess 164 could be machined directly into the plastic material of the lower portion 142, or could be provided by screw sheaths inserted into holes.

The interlock features 160 can be spaced around the lower portion 140 at equal angular intervals. Each interlock feature 160 can include two side faces 166. Each side face 166 can lie in a plane that passes through the center axis A (see FIG. 1) of the retaining ring 110.

The thickness of the main body 150 of the lower portion 140 (i.e., in a region other than the interlock feature or the rims) should be larger than the thickness of substrate 10. On the other hand, if the main body 150 is too thick, the bottom surface of the retaining ring 110 will be subject to deformation due to the flexible nature of the lower portion 140. The initial thickness of main body 150 may be about 50 to 1000 mils, e.g., 200 to 600 mils, depending on the needs of the manufacturer.

The channels 130 extend partially into, not entirely through, the main body 150 of the lower portion 140. The lower portion 140 can be replaced when the channels 130 have been worn. For example, the channels 130 can have a depth of about 100 to 400 mils, depending on the desired replacement frequency.

Adjacent the bottom surface 114, the inner surface 116 of the lower portion 140 of the retaining ring can have an inner diameter just larger than the substrate diameter, e.g., about 1-2 mm larger than the substrate diameter, so as to accommodate positioning tolerances of the substrate loading system. The retaining ring 110 can have a radial width of about half an inch.

In some implementations, the inner surface 116 of the lower portion 140 includes a vertical cylindrical section 116*a* adjacent to the bottom surface 114, and a slanted section 116*b* adjacent to the top surface 112. The slanted section 116*b* can slope inwardly from top to bottom.

The upper portion 142 of the retaining ring 110 is formed of a material, e.g., a metal or ceramic, that is more rigid than the plastic of the lower portion 140. An advantage of having the material of the upper portion 142 be harder than the plastic of the lower portion 140 is that the overall rigidity of the retaining ring 110 can be increased, thus reducing deformation of the lower portion 140 when the retaining ring is attached to the carrier head 100, and reducing break-in time.

The upper portion 142 of the retaining ring 110 includes a plurality of thick sections 170 and a plurality of thin sections 172. The bottom surface 176 of the upper portion 142 includes a plurality of azimuthally spaced apart recesses 174; the portions of the upper portion 142 above the recess 174 define the thin sections 172. The recesses 174 can be spaced around the upper portion 142 at equal angular intervals.

Each recess 174 can include two side faces 178. Each side face 178 can lie in a plane that passes through the center axis A (see FIG. 1) of the retaining ring 110. As shown in FIG. 2, the recesses 174 are shaped so that the interlock features 160 fit into corresponding recesses 174.

In particular, the inner diameter face of the thick section 170 can be directly abut the outer diameter face of the inner rim 152, and the outer diameter face of the thick section 170 can directly abut the inner diameter face of the outer rim 154. Similarly, each side face 178 of the recess 174 can directly abut the corresponding side face 166 of the interlock feature 160. The bottom of the thick section 170 can directly abut the top surface of the main body 150. The bottom of the thin section 172 can directly abut the top surface 162 of the interlock feature 160. Any of these abutting surfaces, e.g., all of the abutting surfaces, can directly abut without an adhesive. Thus, the upper portion 142 can be secured to the lower portion 140 without use of adhesive.

In some implementations, the thickness of the thick section 170 of the upper portion 140 can be less than the initial thickness of the lower portion 142. However, this is not required; a manufacturer could have a retaining ring 110 in which the thickness of upper portion 140 is equal to or greater than the initial thickness of the lower portion 142. An advantage of the thickness of upper portion 140 being less than the initial thickness of lower portion 142 is increased lifetime of the retaining ring.

The upper portion 142 can include a plurality of apertures 180. The apertures 180 can be located in the thin sections 172 of the upper portion 142. The apertures 180 extend entirely through the thin sections 172. When the upper portion 142 is inserted into the gap 156 in the lower portion 140, the apertures 180 align with the threaded recesses 164 in the interlock features 160. The apertures 180 can be spaced apart at equal angular intervals about the retaining ring 110. In some implementations, there is exactly one aperture 180 per thin section 172.

Figure 5:
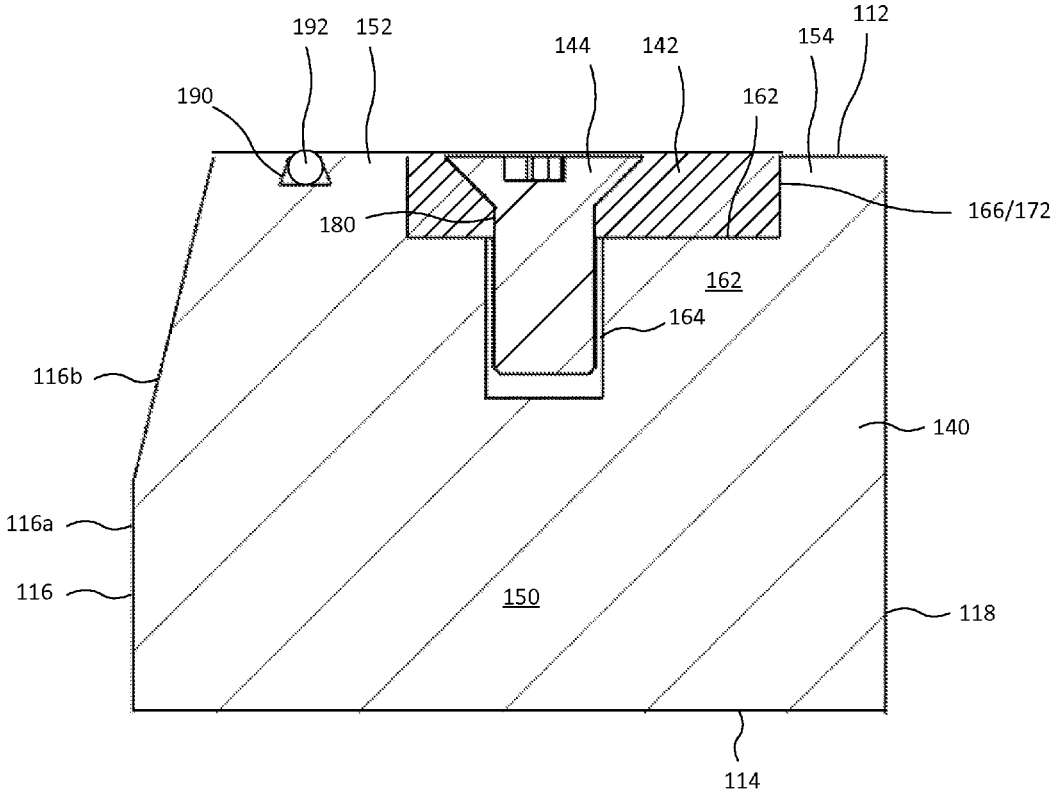
FIG. 5 is a cross-sectional view of the retaining ring.

Mechanical fasteners 144, e.g., screws or bolts, extend through the apertures 180 and into the threaded recesses 164 to secure the upper portion 142 to the lower portion 140. As shown in FIG. 5, once assembled, the top surface 182 of the fastener 144 can be slightly recesses relative to the top surface 112 of the retaining ring 110.

The upper surface 112 of the upper portion 142 can also include a plurality of threaded receiving recesses 139. The threaded receiving recesses 139 can be located in the thick sections 170 of the upper portion 142. The threaded receiving recesses 139 extend partially, but not entirely, through the thick section 170 upper portion 142. The threaded receiving recesses 139 can be spaced apart at equal angular intervals about the retaining ring 110. In some implementations, there is exactly one threaded receiving recess 139 per thick section 170. For example, each threaded receiving recess 139 can be positioned at the azimuthal center of a thick section 170. The threads of the receiving recesses 139 could be machined directly into the material of the upper portion 142, or could be provided by screw sheaths inserted into holes. Mechanical fasteners 136, e.g., screws or bolts, can extend through passages 138 in the base 102 (see FIG. 1) into the aligned threaded receiving recesses 139 to secure the retaining ring 110 to the carrier head 100.

Optionally an annular recess 190 that extends entirely around the retaining ring 110 can be formed on the top surface of the inner rim 152 of the lower portion 140. An O-ring 192 can fit into the annular recess 190. When the retaining ring 110 is secured to the carrier head 100, the O-ring 192 is compressed between the rigid body to which the retaining ring is attached, e.g., the base 102, and the retaining ring 110. In conjunction with the inner rim 152 of the lower portion 140 extending along the entire inner side of the upper portion 142, the O-ring 192 helps prevent slurry from reaching the metal of the upper portion 142, thereby potentially reducing corrosion and associated defects.

Although the retaining ring 110 can include channels 130 for slurry transport in bottom surface 114 of the lower portion 140, and there can be recesses in the top surface of the lower portion 140 to assist in securing of the lower portion 140 to the upper portion 142, the lower portion 140 lacks any aperture that extends from the top surface to the bottom surface of the lower portion.

In some implementations, the retaining ring 110 has one or more through holes that extend horizontally or at a small angle from horizontal through the body of the retaining ring from the inner diameter to the outer diameter for allowing fluid, e.g., air or water, to pass from the interior to the exterior, or from the exterior to the interior, of the retaining ring during polishing. The through-holes can extend through the lower portion 140. The through holes can be evenly spaced around the retaining ring.

Although the side surfaces 166 and 178 of the recess interlock feature 160 and recess 174 are illustrated as substantially vertical, the surfaces could be canted to form a dovetail connection when the interlock feature 160 is inserted into the recess 174.

The present invention has been described in terms of a number of embodiments. The invention, however, is not limited to the embodiments depicted and described. Rather, the scope of the invention is defined by the appended claims.

What is claimed is:

1. A retaining ring, comprising:

an annular lower portion having a main body with a bottom surface for contacting a polishing pad during polishing, an inner rim projecting upward from the main body, an outer rim projecting upward from the main body and separated from the inner rim by a gap, and a plurality of azimuthally separated interlock features positioned between the inner rim and the outer rim, each interlock feature projecting upwardly from the main body, wherein the lower portion comprises a plurality of threaded recesses formed in top surfaces of at least some of the interlock features, and wherein the lower portion is a plastic; and an annular upper portion having a top surface and a bottom surface and a plurality of azimuthally separated recesses in the bottom surface, the recesses in the bottom surface of the annular upper portion defining thin portions of the upper portion and azimuthally separated thicker sections between the thin portions, wherein the plurality of interlock features fit into the plurality of recesses, wherein the upper portion includes a plurality of apertures formed only through the thin portions and aligned with the plurality of threaded recesses, and wherein the upper portion includes a plurality of threaded holes formed only in at least some of the thicker sections, the plurality of threaded holes extending partially but not entirely through the thicker sections of the upper portion, and wherein the upper portion is a material that is more rigid than the plastic.

2. The retaining ring of claim 1, wherein the material is a metal or ceramic.

3. The retaining ring of claim 1, wherein the lower portion has a durometer measurement between about 80 and 95 on the Shore D scale.

4. The retaining ring of claim 1, further comprising a plurality of mechanical fasteners extending through the plurality of apertures into the plurality of threaded recesses.

5. The retaining ring of claim 4, wherein top surfaces of the plurality of mechanical fasteners are recessed relative to the top surface of the upper portion.

6. The retaining ring of claim 1, wherein the top surface of the upper portion is flush with a top surface of the inner rim.

7. The retaining ring of claim 1, wherein a top surface of the inner rim is flush with a top surface of the outer rim.

8. The retaining ring of claim 1, further comprising an annular recess in a top surface of the inner rim and an O-ring fit into the annular recess.

9. The retaining ring of claim 1, wherein the bottom surface of the lower portion has channels for slurry transport.

10. The retaining ring of claim 1, wherein the lower portion is secured to the upper portion without adhesive.

11. The retaining ring of claim 1, wherein azimuthal side surfaces of the plurality of interlock features directly contact azimuthal side surfaces of the plurality of recesses.

12. The retaining ring of claim 1, wherein the azimuthally separated interlock features extend entirely across the gap from the inner rim to the outer rim.

13. The retaining ring of claim 1, wherein the thin portions of the upper portion fit between the inner rim and the outer rim of the lower portion.

14. The retaining ring of claim 1, wherein the azimuthally separated interlock features are spaced at equal angular intervals around the lower portion.

15. The retaining ring of claim 1, wherein inner and outer surfaces of the plurality of interlock features directly contact side surfaces of the inner rim and outer rim, respectively.

16. A carrier head, comprising:

a housing;

a substrate mounting surface supported by the housing; and a retaining ring having an annular lower portion surrounding the substrate mounting surface, the annular lower portion including a main body with a bottom surface for contacting a polishing pad during polishing, an inner rim projecting upward from the main body, an outer rim projecting upward from the main body and separated from the inner rim by a gap, and a plurality of azimuthally separated interlock features positioned between the inner rim and the outer rim, each interlock feature projecting upwardly from the main body, wherein the lower portion is a plastic, and wherein the lower portion comprises a plurality of threaded recesses formed in top surfaces of at least some of the interlock features, and an annular upper portion secured to the housing, the annular upper portion having a top surface and a bottom surface and a plurality of azimuthally separated recesses in the bottom surface, the recesses in the bottom surface of the annular upper portion defining thin portions of the upper portion and azimuthally separated thicker sections between the thin portions, wherein the plurality of interlock features fit into the plurality of recesses, wherein the upper portion includes a plurality of apertures formed through the thin portions and aligned with the plurality of threaded recesses, and wherein the upper portion includes a plurality of threaded holes located in at least some of the thicker sections, the plurality of threaded holes extending partially but not entirely through the thicker sections of the upper portion, and wherein the upper portion is a material that is more rigid than the plastic.

17. The carrier head of claim 16, wherein a plurality of mechanical fasteners extend through the plurality of apertures into the plurality of threaded recesses.

18. The carrier head of claim 17, wherein a second plurality of fasteners extend through the passages into the threaded holes to mechanically affix the retaining ring to the housing.

* * * * *